US005577282A

United States Patent [19]

Turner et al.

[11] Patent Number: 5,577,282

[45] Date of Patent: Nov. 26, 1996

[54] TEXTILE WET PROCESSING MACHINE AND METHOD

[75] Inventors: James K. Turner; William C. Sturkey; Thomas W. Van Scyoc, all of Stanley, N.C.

[73] Assignee: Gaston County Dyeing Machine Company, Stanley, N.C.

[21] Appl. No.: 447,192

[22] Filed: May 22, 1995

[51] Int. Cl.[6] ..... D06B 3/28

[52] U.S. Cl. ..... 8/152; 8/158; 68/178

[58] Field of Search ..... 8/152, 158; 68/177, 68/178

[56] References Cited

U.S. PATENT DOCUMENTS

| | | | |
|---|---|---|---|
| 1,209,880 | 12/1916 | Palmer . | |
| 1,531,788 | 3/1925 | Jefferson . | |
| 2,503,817 | 4/1950 | Graham . | |
| 3,497,311 | 2/1970 | Masuda . | |
| 3,587,256 | 6/1971 | Spara | 68/178 X |
| 3,679,357 | 7/1972 | Christ et al. . | |
| 3,779,049 | 12/1973 | Becker . | |
| 3,921,420 | 11/1975 | Aurich et al. . | |
| 3,949,575 | 4/1976 | Turner et al. . | |
| 4,001,945 | 1/1977 | Aurich et al. . | |
| 4,007,517 | 2/1977 | Turner et al. . | |
| 4,020,658 | 5/1977 | Thies, Jr. . | |
| 4,082,504 | 4/1978 | Von Der Eltz | 8/152 X |
| 4,114,407 | 9/1978 | Turner et al. . | |
| 4,291,555 | 9/1981 | Barriquand . | |
| 4,318,286 | 3/1982 | Sturkey . | |
| 4,340,986 | 7/1982 | Sturkey . | |
| 4,360,937 | 11/1982 | Putnam | 68/178 X |
| 4,422,308 | 12/1983 | Pfeiffer et al. . | |
| 4,440,003 | 4/1984 | Koch . | |
| 4,570,464 | 2/1986 | Thompson . | |
| 4,766,743 | 8/1988 | Biancalani et al. . | |
| 4,873,847 | 10/1989 | Kasai et al. . | |
| 4,936,119 | 6/1990 | Thompson . | |
| 5,012,657 | 5/1991 | Serracant-Clermont et al. . | |
| 5,014,526 | 5/1991 | Hacker et al. . | |
| 5,299,339 | 4/1994 | Georgantas | 68/178 X |

FOREIGN PATENT DOCUMENTS

| | | | |
|---|---|---|---|
| 2945942 | 5/1981 | Germany | 68/178 |
| 3605123 | 12/1986 | Germany | 68/177 |
| 23703 | 1/1972 | Japan | 68/178 |

*Primary Examiner*—Philip R. Coe

*Attorney, Agent, or Firm*—Shefte, Pinckney & Sawyer

[57] ABSTRACT

A jet-type textile wet processing machine is equipped with a pivotable inner wall assembly within the entrance end of the fabric chamber in the processing vessel for selective pivotal disposition to control definition of the plug form of the fabric advancing through the chamber and has an internally segmented jet nozzle structure for creating annularly differentiated impinging streams of processing liquid on the traveling fabric rope. Unique processing applications enabled by the machine include simultaneously treating within a single chamber two independent disconnected endless fabric ropes or a single fabric rope or a single fabric rope in doubled form.

32 Claims, 8 Drawing Sheets

TEXTILE WET PROCESSING MACHINE AND METHOD

BACKGROUND OF THE INVENTION

The present invention relates generally to textile machines of the type used for wet processing of textile fabric in continuous cloth rope form and to methods of wet processing textile fabrics utilizing such machines.

Textile wet processing machines have long been utilized in the textile industry for piece dyeing of textile fabrics in endless cloth rope form. In machines of this type, e.g., jet dyeing machines, the endless fabric rope is circulated through a processing chamber containing a treating liquid, wherein the cloth rope is formed in a plaited plug form. The cloth plug advances through the treating chamber by continuous drawing off of the leading end of the plug and conveyance thereof to the trailing end of the plug, commonly accomplished by means of a fabric lifting reel and a downstream jet of the textile treating liquid.

A common form of treating chamber utilized in such textile wet processing machines is of a U-shape defined by a pair of laterally spaced U-shaped side walls joined at their outer edges by a U-shaped transverse wall. The chamber is situated in the bottom of the treating vessel, the side walls typically being perforated to permit flow of the treating liquid therethrough between the interior of the chamber and the bottom liquid containment area of the vessel. It is also common to provide an inner transverse wall between the inner edges of the perforated side walls to maintain the fabric plug at least partially submerged in the treating liquid within the vessel, the inner wall typically extending substantially the full extent of the chamber for such purpose.

Disadvantageously, however, the provision of a treating chamber with an inner wall restricts the chamber to a defined volume which may limit the flexibility of the wet processing machine for treating different types of fabrics or for treating different lengths of a given fabric. One function of the inner wall is to define the plug form of the cloth rope. As will be understood, fabrics having different characteristics, e.g., different thicknesses and weight per yard, will behave differently in the wet processing machine and therefore may require a treating chamber of differing volumetric size in order to enable the machine to realize its maximum capacity for treating the individual fabric. However, when the treating chamber has a fixed inner wall, the capacity of the machine for processing thicker and heavier fabrics may be limited thereby. Conversely, the machine may be less than optimally effective for treating lighter weight fabrics for which a treating chamber of relatively smaller volume would be preferred.

One solution which has proved effective to overcome the above-described disadvantages is disclosed in U.S. Pat. No. 5,014,526, the invention of which provides an inner wall having lateral flanges for mounting by special fasteners in differing dispositions between the side walls of the U-shaped chamber of such wet processing machines, utilizing the existing perforations in the side walls to selectively vary the cross-sectional size of the chamber so as to accommodate particular processing requirements of different fabrics.

However, one additional disadvantage not addressed by the invention of U.S. Pat. No. 5,014,526 is that, with any given type of fabric, the lengthwise extent of the fabric which will be maintained in plug form within the chamber will be a function of the total overall length of the fabric rope being processed. Since the inner wall will tend to present an additional source of friction retarding advancing movement of the fabric plug through the chamber, the plug formed when processing shorter lengths of fabric will tend to reside primarily within the entrance end of the chamber and, hence, the inner wall may impair the ability of the lifter reel to freely withdraw the fabric from the leading end of the plug.

Another aspect of the operation of textile wet processing machines of the aforedescribed type which has received considerable attention in recent years is the overall elapsed time required to complete the processing of a given fabric rope. A fundamental objective in improving wet processing machines and advancing the technology of wet processing methodology is to reduce the average processing time without negatively affecting fabric quality. Various parameters of the basic wet processing operation of such machines are recognized to affect overall processing time, two basic factors for any given type of fabric being the length of the fabric rope and the traveling speed of the fabric through the machine which, in turn, determines the time required for the entire length of the fabric rope to make one complete circulation through the machine. To a significant extent, the traveling speed of the fabric is determined by the combined effect of the fabric lifting reel and the liquid impingement action of the downstream liquid jet on the fabric, which collectively serve to transport the fabric so as to maintain its circulating motion through the processing chamber. With regard to the liquid jet itself, the mechanical arrangement of the jet structure, i.e., the size of the liquid jet gap and the overall flow capacity of the jet in conjunction with the associated liquid pump supplying the processing liquid to the jet, determines the manner and force with which the jetted liquid impinges and entrains the fabric and, in turn, attention has been directed to refinement and improvement of the structure and operation of liquid jets to accommodate more rapid transport of fabrics without negatively affecting the liquid interaction with the fabric as well as to accommodate use with a variety of differing fabrics.

Efforts have also been directed to increasing the capacity of processing machines without increasing processing time. Toward this end, experimentation has been conducted with running two lengths of textile fabric simultaneously through the same treating chamber, lifting reel and liquid impinging jet. One possibility contemplated is a so-called "piggyback" operation wherein one length of fabric is transported in conventional fashion in an endless rope form with a leading end of the second length of fabric being sewn to the first fabric rope and allowed to extend therefrom in trailing relation more or less side-by-side with the fabric rope with the opposite end of the second fabric being left unattached. An alternative possibility is to operate the machine with two independent endless fabric ropes circulating through the machine in side-by-side relation without any attachment between the two ropes. In each case, problems have been encountered with the two fabrics becoming twisted or looped with respect to one another which have prevented commercially satisfactory and effective use of these techniques.

SUMMARY OF THE INVENTION

It is accordingly a basic object of the present invention to improve textile wet processing machinery and methodology of the aforementioned type to permit greater flexibility of use for differing fabrics and differing fabric capacities. More specifically, it is an object of the present invention to minimize the inner wall of the treating chamber in such machines without impairing plug formation of the fabric rope being processed. A further object of the present invention is to provide a jet structure for use in such machines providing selectively adjustable flow characteristics. Another object is to provide a wet processing machine of the basic type described which is capable of effectively and reliably processing dual lengths of textile fabric simultaneously.

Basically, the apparatus and method of the present invention are applicable to essentially any textile machine wherein fabric is wet processed in continuous cloth rope form by continuous circulation of the cloth rope in plug form through a bath of processing liquid by progressively withdrawing the cloth rope from an exit end of the liquid bath and returning the rope to an entrance end of the bath. Machines of such type typically have a vessel for containing processing liquid and a U-shaped chamber within the vessel for supporting the plug of cloth rope during circulatory movement through the vessel. A driven lifter reel and liquid jet arrangement are commonly utilized to maintain recirculatory transport of the cloth rope through the machine.

According to one aspect of the present invention, an improved form of U-shaped chamber is provided with an adjustable inner wall. Basically, the U-shaped chamber is defined by laterally opposed side walls connected by an outer wall. According to the present invention, the inner wall is movably supported, preferably pivotably, at the cloth entrance end of the U-shaped chamber between the side walls at a spacing from the outer wall. In this manner, the inner wall is selectively pivotable to adjust the spacing between the inner wall and the outer wall so as to control plug formation of the cloth rope, the pivotal disposition of the inner wall typically being determined according to the physical characteristics of the fabric being processed, e.g., length, thickness, weight per yard, etc. Under the present invention, the inner wall has a terminal end disposed between the cloth entrance and exit ends of the U-shaped chamber, i.e., the inner wall terminates at a spacing from the exit end of the chamber, whereby the plug form of the cloth rope is unrestricted within the inward region of the U-shaped chamber during travel from the terminal end of the inner wall to the exit end of the chamber.

Appropriate means may be provided for adjustably affixing the pivotal disposition of the inner wall to the side walls of the U-shaped chamber at selectively varying spacings to the outer wall or, alternatively, the inner wall may be left unsecured to the side walls except at the location of its pivotal support in order to hang gravitationally therefrom. The side walls preferably extend to an elevation sufficiently above the terminal end of the inner wall to ensure that the cloth rope is retained within the chamber. A deflector plate or other suitable means is also preferably disposed within the U-shaped chamber at an elevation above the inner wall to deflect the cloth rope outwardly toward the outer wall as the rope enters the U-shaped chamber.

According to another aspect of the present invention, the jet structure or other like means by which the cloth rope is circulated through the vessel is constructed to create first and second continuous streams of the processing liquid for impingement onto the cloth rope at respective locations annularly about the rope.

In the preferred embodiment, the jet structure or other liquid impinging means includes a housing which defines a central passageway for travel of the cloth rope therethrough, a liquid delivery chamber about the central passageway, a venturi opening from the liquid delivery chamber into the central passageway, and first and second inlets opening into the liquid delivery chamber at annular spacings relative to the central passageway to deliver the two liquid streams into the passageway. Preferably, the housing includes a partition or other suitable means for dividing the liquid delivery chamber into first and second sub-chambers each of which communicates with a respective one of the liquid inlets, each of the sub-chambers in turn communicating with the venturi opening through a predetermined annular extent about the central passageway. The respective annular extents of the two sub-chambers are preferably selected to have respectively differing annular dimensions and/or differing liquid flow characteristics. By way of example, one of the sub-chambers may have an annular extent of about 120° while the other sub-chamber's annular extent is about 240°. The jet structure is preferably disposed relative to the lifter reel at an essentially downward orientation in order to direct the processing liquid streams downwardly toward the vessel.

Another aspect of the present invention improves the methodology of wet processing of textile fabric by simultaneously circulating two independent and unattached textile fabrics, each in continuous cloth rope form, through the liquid bath in generally side-by-side relation to one another. To prevent twisting or other entanglement of the two fabrics, the method of this invention contemplates directing the two cloth ropes toward laterally opposite sides of the entrance end of the liquid bath when returning the ropes into the bath after withdrawal by the lifter reel and conveyance through the liquid jet structure.

In the preferred embodiment, the laterally opposite direction of the two cloth ropes into the bath is accomplished by directing the ropes collectively through a common liquid jet structure which, as above-described, impinges the collective ropes with two continuous processing liquid streams at respective annular locations about the ropes and., then, directing the two cloth ropes downstream of the jet structure onto a common deflector plate disposed generally above the entrance end of the liquid bath. As another alternative, a single endless length of cloth rope may be processed under the present invention in similar manner to the aforedescribed processing of two independent cloth ropes by circulating the cloth rope through the liquid bath in a doubled form having two extents of the rope in generally side-by-side relation to one another and connected endwise to one another in crossing relation.

DETAILED DESCRIPTION OF THE PREFERRED EMBODIMENT

Figure 1:
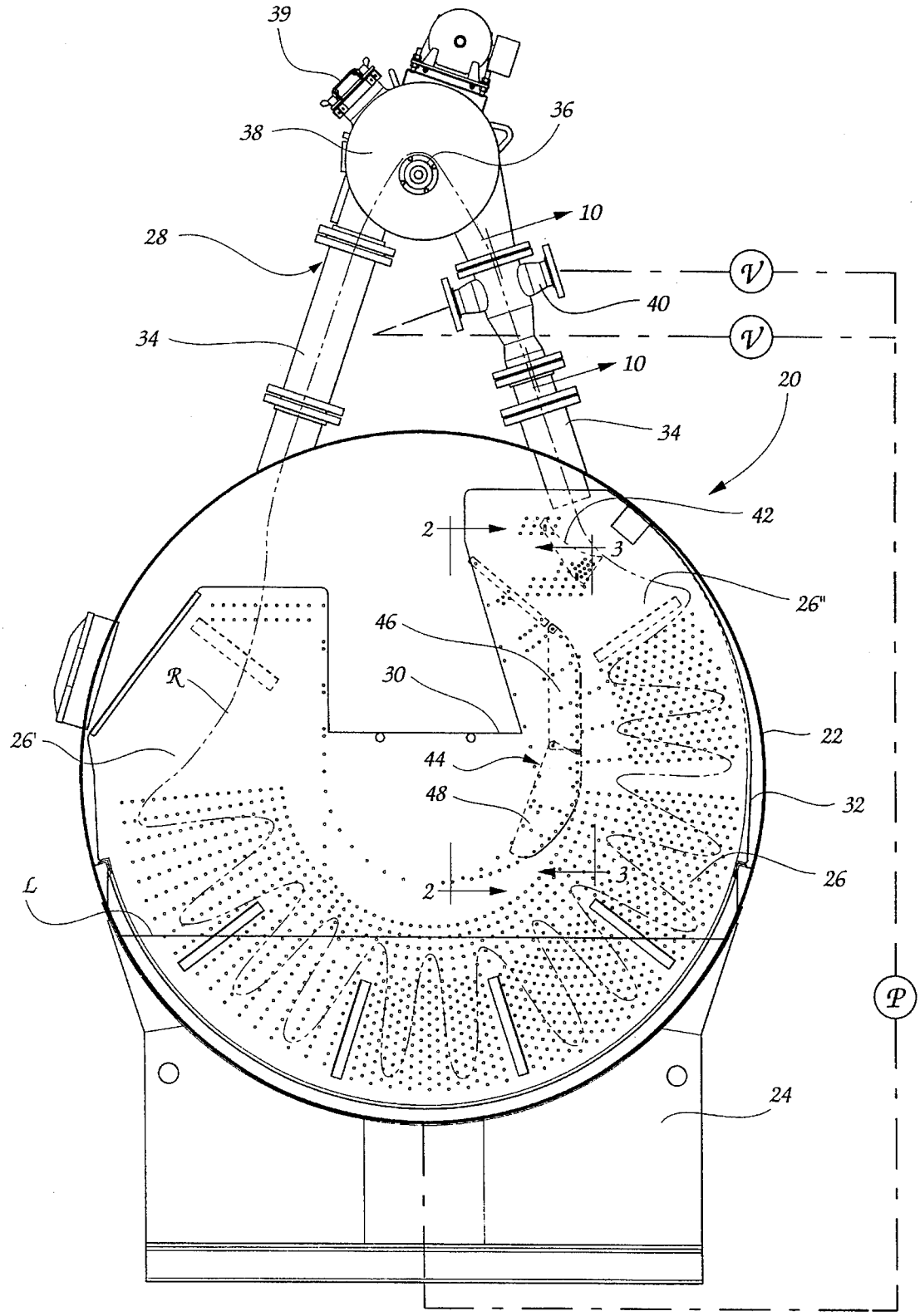
FIG. 1 is a vertical cross-sectional view of a jet-type textile wet processing machine, according to the preferred embodiment of the present invention.
Figure 2:
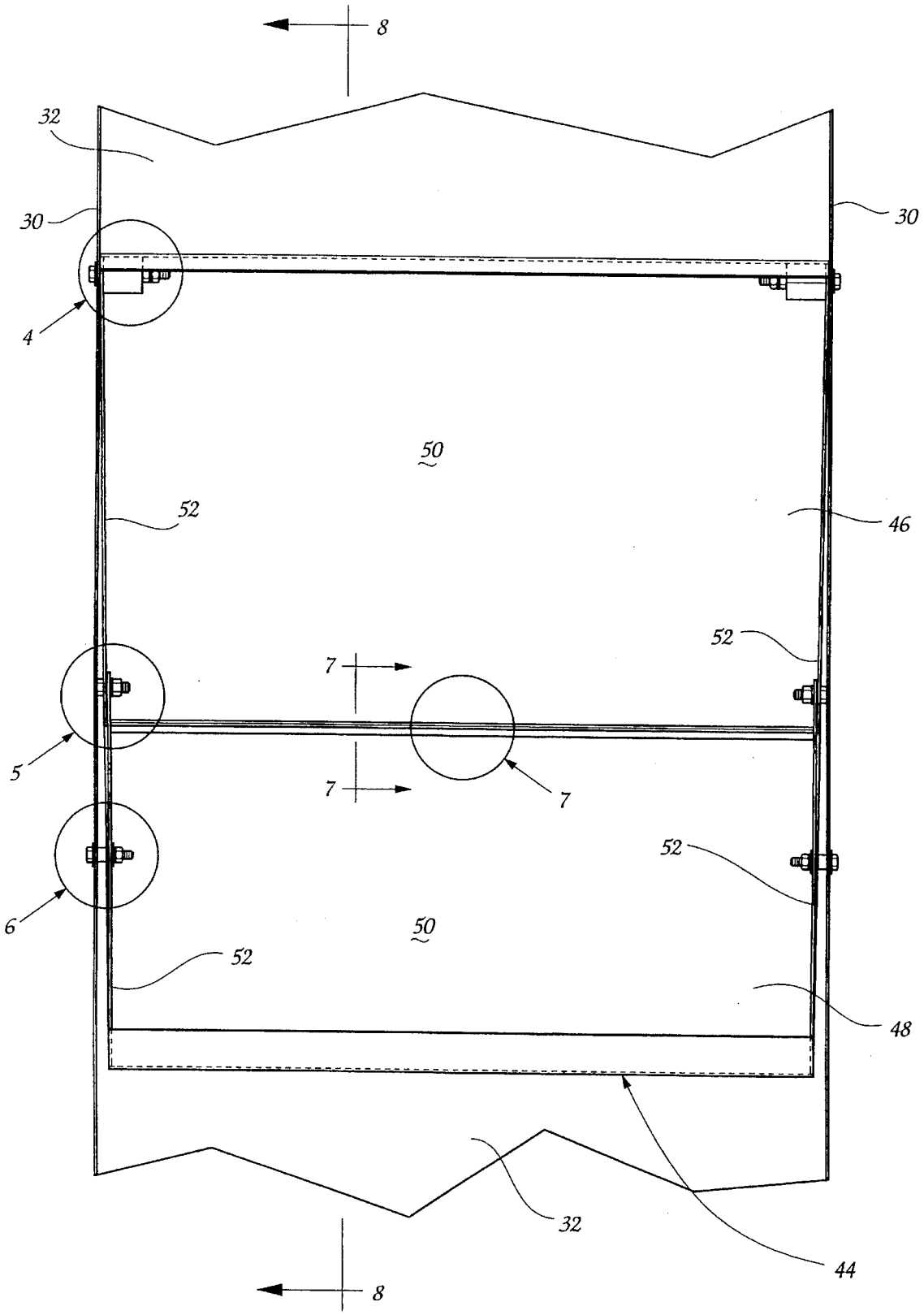
FIG. 2 is a partial vertical cross-sectional view of the wet processing machine of FIG. 1, taken along line 2—2 thereof.
Figure 3:
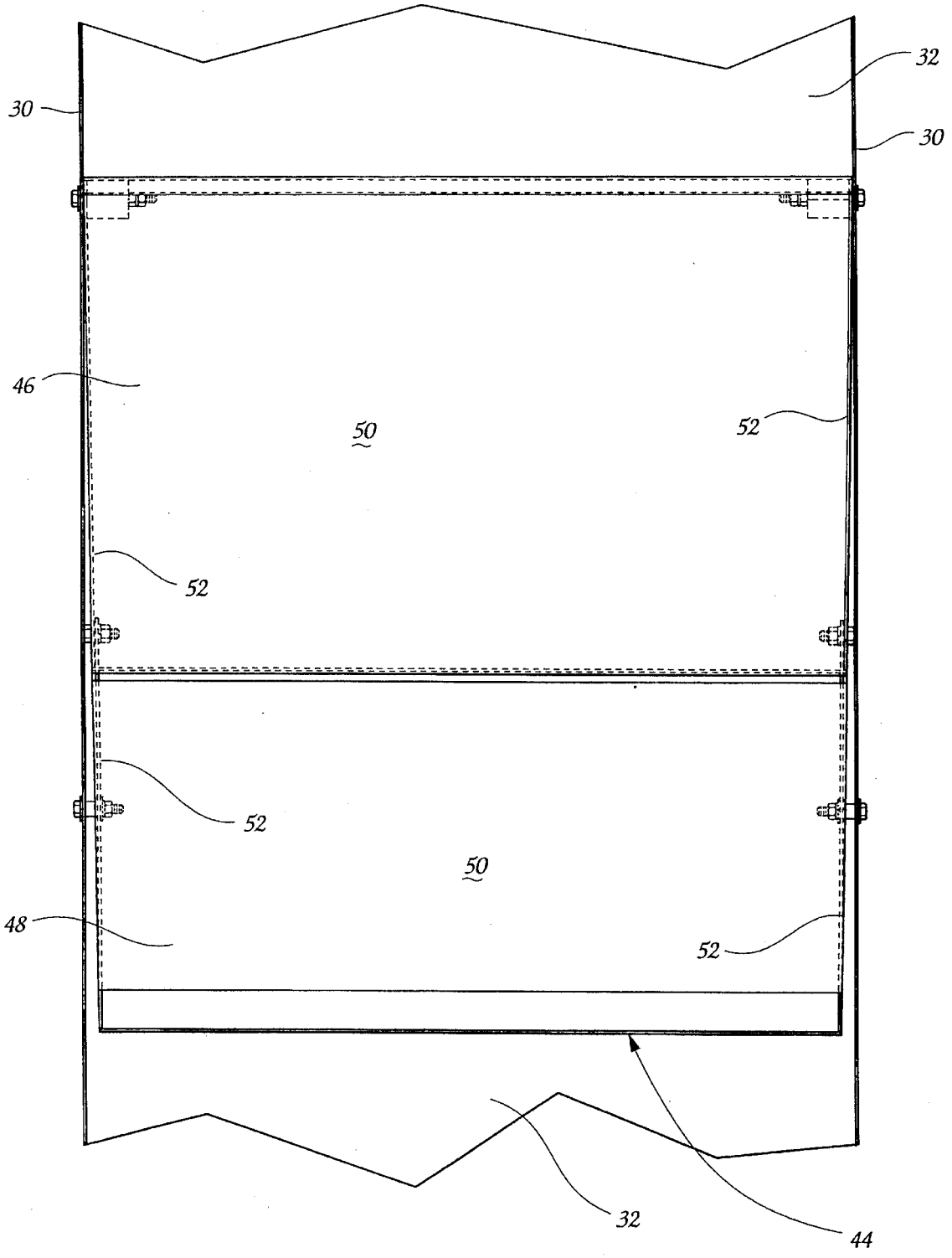
FIG. 3 is another partial vertical cross-sectional view of the wet processing machine of FIG. 1, taken along line 3—3 thereof.
Figure 7:
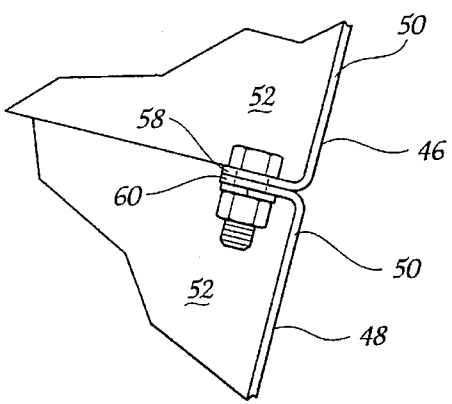
FIG. 7 is an enlargement of the inner wall arrangement of the processing chamber in the wet processing machine of FIGS. 1–3, taken at the area indicated at 7 in FIG. 2 as viewed along line 7—7 thereof.

Referring now to the accompanying drawings and initially to FIG. 1, the present invention is illustrated as preferably embodied in a textile wet processing machine of the jet type commonly employed for the dyeing of textile fabrics in continuous cloth rope form, generally indicated at 20. As those persons skilled in the art will readily recognize and understand, varying forms of such textile wet processing machines are well known in the textile industry. Further, it is contemplated that the present invention may be readily adapted to and incorporated in many such machines. Accordingly, the machine 10 is herein illustrated and described only schematically to the extent necessary to facilitate an understanding of the present invention and to be representative of the application of the present invention to any suitable conventional wet processing machine.

Basically, the machine 10 includes a closed pressure vessel 22, typically of cylindrical form disposed with a generally horizontally extending axis and mounted on a floor-supported base 24. Commonly, the machine 20 will be utilized for simultaneously processing several separate fabric pieces, each in continuous rope form. For this purpose, the axial extent of the cylindrical vessel is equipped with a plurality of treating sections or units arranged side-by-side along the axial length of the machine, corresponding in number to the number of differing fabric pieces to be treated in any given wet processing operation. For sake of simplicity, FIG. 1 illustrates one such section or unit.

In each processing section or unit of the machine, a U-shaped treating chamber 26 is disposed within the bottom of the vessel 22 and a corresponding superstructure 28 is mounted at the top of the vessel 22 for circulating a respective endless cloth rope R (formed by sewing together the opposite ends of an extended length of textile fabric) through the machine 20 for wet processing by a liquid L contained within the vessel 22. As will be understood, the machine 20 may be constructed with any desired number of treating sections or units, within practical limits.

A U-shaped chamber 26 basically comprises a pair of U-shaped side walls 30 supported in facing parallel relation to one another spaced axially along the length of the vessel 22 by a correspondingly U-shaped outer wall 32 extending transversely between the respective outer edges of the side walls 30, the outer wall 32 being affixed to the interior of the vessel 22 to support the chamber 26 in place therein. As is conventional, the side walls 30 of the chamber 26 are perforated to permit liquid flow therethrough into and out of the interior of the chamber 26. The outer wall 32 may be perforate or imperforate as desired.

The superstructure 28 basically comprises a tubular conduit 34 essentially of an inverted V-shape mounted to the vessel 22 with the opposite ends of the conduit 34 aligned respectively with the opposite upward openings into the U-shaped chamber 26. A driven lifter reel 36 is rotatably disposed within a housing 38 at the uppermost apex of the tubular conduit 34 for continuously and progressively withdrawing the fabric rope R from the exit end 26' of the chamber 26 into the conduit 34 and a liquid jet nozzle structure 40 is provided in the conduit 34 downstream of the lifter reel 36 in a generally downwardly oriented disposition to continuously apply treating liquid L under pressure to the fabric rope R in the same direction as the rope R is traveling through the conduit 34, thereby to provide an impinging and entraining force to the rope R. A circulation pump P continuously withdraws treating liquid L from the bottom of the vessel 22 and delivers the withdrawn liquid under pressure to the nozzle structure 40, in a known conventional fashion. An openable access port 39 is provided in the housing 38 adjacent the lifter reel 36 for easy feeding of a cloth rope R into, and removable therefrom, the vessel 22.

The terminal end of the conduit 34 downstream of the jet nozzle structure 40 opens vertically downwardly into the opposite entrance end 26" of the chamber 26. As the cloth rope R and the pressurized entraining liquid L exit the conduit 34, the cloth rope R settles downwardly into the entrance end of the chamber 26 in plaits or folds such that the rope R assumes the general form of a plug within the chamber 26. The perforations in the side walls 30 of the chamber 26 enable the returning liquid L to flow therethrough into the bottom of the vessel 22 for recirculation through the pump and the jet nozzle structure 40.

As thus far described, the wet processing machine 20 and its basic method of operation is essentially conventional. It is further conventional to equip the U-shaped chamber 26 with an inner wall of a U-shape essentially corresponding to that of the side and outer walls 30,32 to extend in spaced relation to the outer wall 32 for essentially the full extent of the chamber 26 between its entrance and exit ends 26',26". However, in accordance with one aspect of the present invention, such a conventional inner wall is eliminated from the machine 20 and, in its place, a partial inner wall assembly 44 is pivotably mounted at the entrance end of the chamber 26 between the perforated chamber side walls 30 to permit selective pivotable adjusting of the inner wall assembly 44 toward and away from the outer chamber wall 32 to change the cross-sectional area of the entrance end of the chamber 26. However, in accordance with the present invention, the inner wall assembly 44 terminates shortly downstream of the entrance end 26" to the chamber 26 and substantially in advance of the exit end 26' (as viewed in relation to the direction of fabric travel) so that the advancing movement of the fabric plug through the chamber 26 is essentially unrestricted at the radially inward side of the chamber once the fabric rope R entering the chamber 26 is caused to form into a plaited plug.

More specifically, as best seen in FIGS. 2–7, the inner wall assembly 44 basically comprises upper and lower wall members 46,48, respectively, affixed end-to-end with one another. Each of the upper and lower wall members 46,48 has an essentially plate-like main body 50 from which side flanges 52 extend from each laterally opposite side edge. The upper end of the upper wall member 46 extending transversely between its side flanges 52 is pivotably supported at each opposite side of the wall member 46 by bolts 54 extending through aligned openings 56 in the side walls 30 of the U-shaped chamber 26, as depicted in enlarged detail in FIG. 4. The lower transverse end edge of the upper wall member 46 and the upper transverse end edge of the lower wall member 48 are formed with respective flanges 58,60 which are bolted in face-abutting relation to join the upper and lower wall members 46,48 with their respective main bodies 50 essentially flush with one another to provide an essentially continuous fabric directing surface (see FIG. 7). In the mounted disposition of the upper and lower wall members 46,48, the respective plate-like main bodies 50 extend downwardly from the pivot mounting into the chamber 26 in opposed spaced facing relation to the outer wall 32 of the chamber 26, with the respective side flanges 52 of the wall members 46,48 projecting radially inwardly toward the axis of the vessel 22 and away from the outer wall 32.

Figure 5:
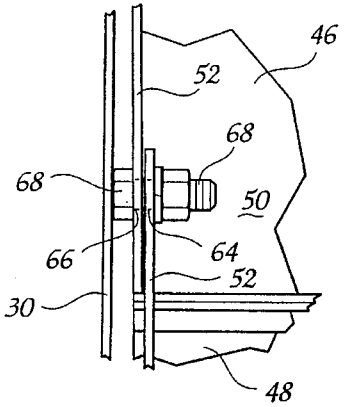
FIG. 5 is an enlargement of the inner wall arrangement of the processing chamber in the wet processing machine of FIGS. 1–3, taken at the area indicated at 5 in FIG. 2.
Figure 4:
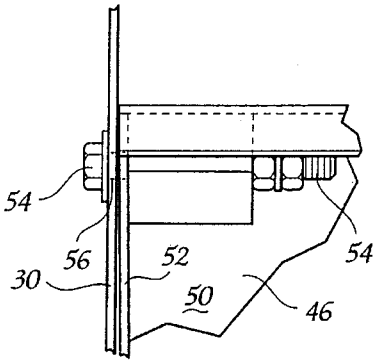
FIG. 4 is an enlargement of the inner wall arrangement of the processing chamber in the wet processing machine of FIGS. 1–3, taken at the area indicated at 4 in FIG. 2.
Figure 8:
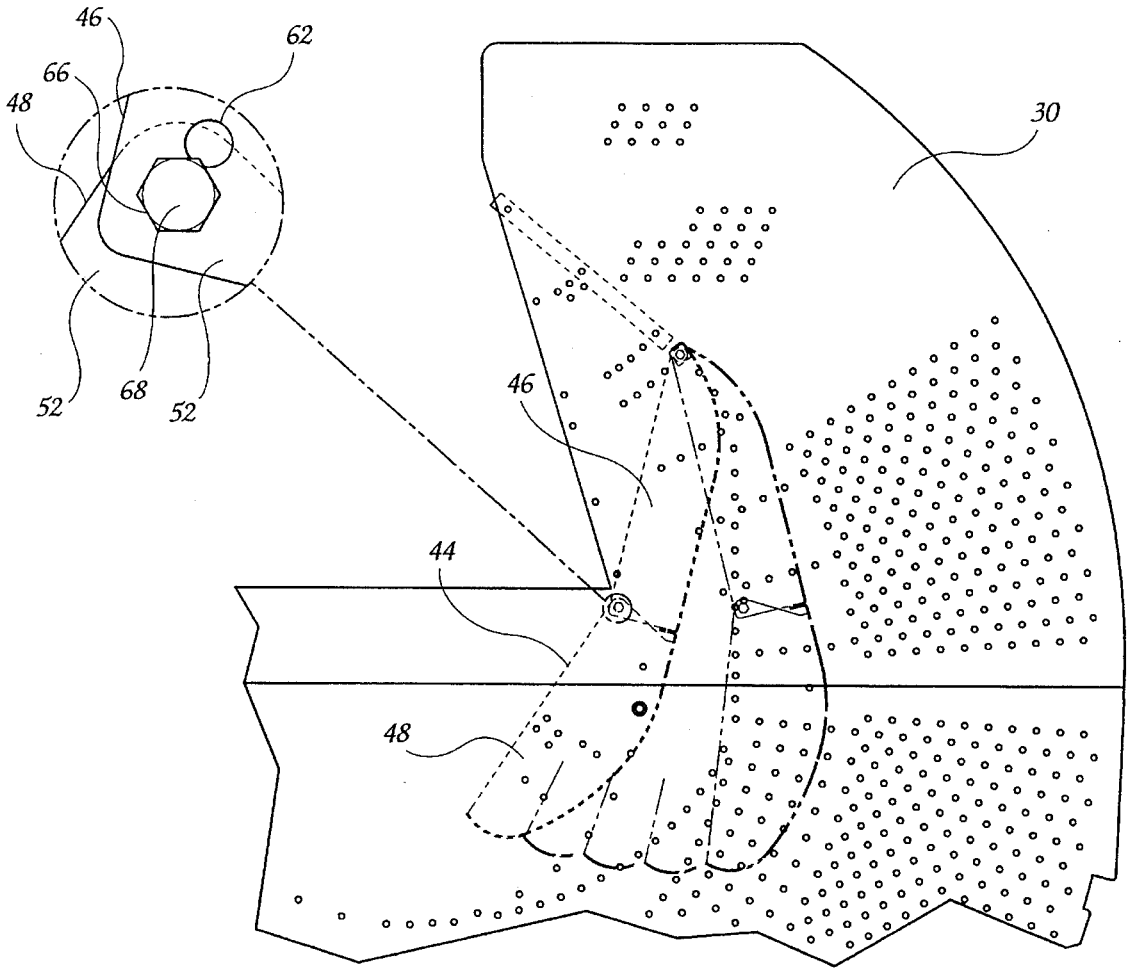
FIG. 8 is a partial vertical cross-sectional view of the inner wall arrangement of the wet processing machine of FIGS. 1–3, taken along line 8—8 of FIG. 2, showing alternative adjustments of the inner wall arrangement.
Figure 9:
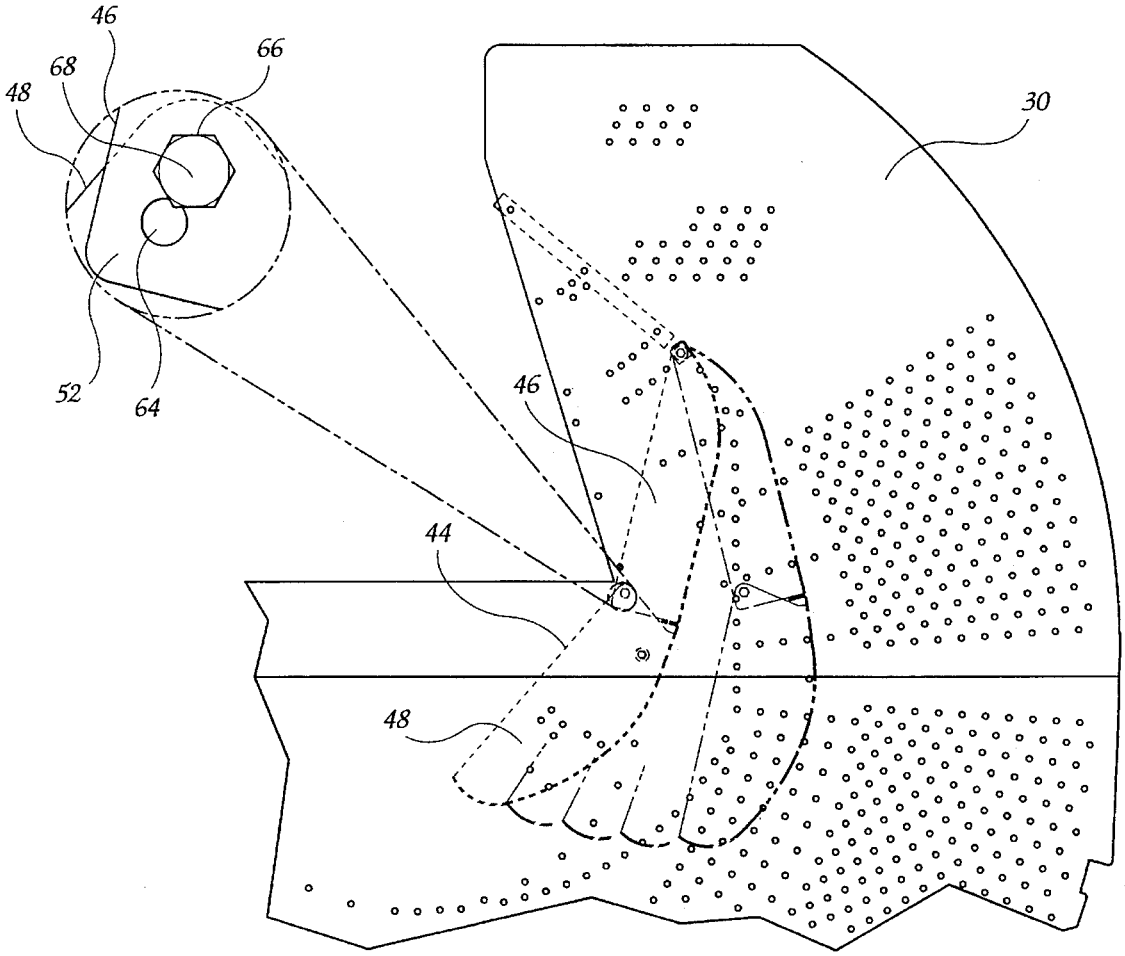
FIG. 9 is a partial vertical cross-sectional view of the inner wall arrangement of the wet processing machine of FIGS. 1–3, taken along line 9—9 of FIG. 2, showing additional adjustments of the inner wall arrangement.

The main body 50 of the upper wall member 46 tapers slightly from its pivoted upward edge to the lower end terminating at the flange 58, while the lower wall member 48 similarly tapers from the flange 60 at its upper end to a further reduced transverse dimension at its lowermost end. At the juncture between the upper and lower wall members 46,48, their respective side flanges 52 overlap with one another to permit the respective side flanges 52 to also be bolted together in such overlapping relation. As best seen in FIGS. 5, 8 and 9, each of the side flanges 52 of the upper wall member 46 is provided with two bolt openings 62,64 at close vertical spacings to one another, and the respective flanges 58,60 of the upper and lower wall members 46,48 are sufficiently flexible to permit the wall members 46,48 to be selectively manipulated sufficiently to orient either set of openings 62,64 with a pair of openings 66 in the side flanges 52 of the lower wall member 48. In this manner, the angular disposition between the upper and lower wall members 46,48 can be slightly adjusted, as shown for comparative purposes in FIGS. 8 and 9, by means of securing bolts 68 extended selectively through the aligned openings 62,66 or 64,66.

Figure 6:
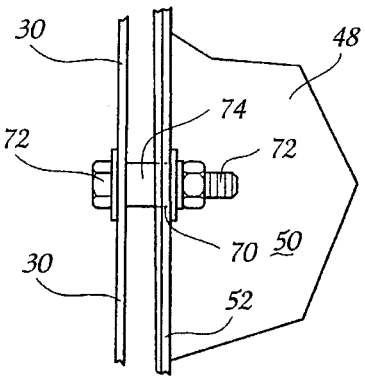
FIG. 6 is an enlargement of the inner wall arrangement of the processing chamber in the wet processing machine of FIGS. 1–3, taken at the area indicated at 6 in FIG. 2.

By virtue of the tapered narrowing of the respective main bodies 50 of the upper and lower wall members 46,48, the head portions of the securing bolts 68 joining the overlapping side flanges 52 at the opposite sides of the inner wall assembly 44 are permitted to rest within the confines of the spaced side walls 30 of the chamber 26 in abutment with their respective inward surfaces, as will also be seen in FIG. 5. At a short spacing below the bolted overlapping side flanges 52, each side flange 52 of the lower wall member 48 is provided with one or more openings 70 which may be positioned through pivotal movement of the inner wall assembly 44 about the bolts 54 to align with any of several selected sets of perforations in the side walls 30 of the chamber 26, thereby permitting the pivoted orientation of the inner wall assembly 44 relative to the outer wall 32 of the chamber 26 to be selectively fixed by securing bolts 72 extending through the aligned side wall perforations and openings 70 and through an intervening annular spacer 74, as depicted in FIG. 6. Alternatively, as will be understood, the securing bolts 72 may be eliminated to permit the inner wall assembly 44 to assume a natural disposition hanging gravitationally from the bolts 54 at the pivot mounting location.

As will thus be understood with reference to FIGS. 8 and 9, the inner wall assembly 44 may be mounted in the above-described manner in various pivoted dispositions between the side walls 30 of the treating chamber 26 to selectively vary its spacing from the outer chamber wall 32 and thereby correspondingly vary the cross-sectional area of the treating chamber 26 at its fabric entrance end. In particular, FIG. 8 depicts the inner wall assembly 44 in four differing pivoted dispositions, with the upper and lower wall members 46,48 oriented at a more open angular disposition relative to one another by the flange-securing bolts 68, while FIG. 9 depicts the inner wall assembly 44 at the same four differing pivoted dispositions but with the upper and lower wall members 46,48 secured by the bolts 68 in a more close, articulated angular disposition relative to one another.

The particular configuration of the inner wall assembly 44 of the present invention results from the discovery that, contrary to conventional wisdom, an inner chamber wall extending substantially continuously from the entrance end to the exit end of the chamber is not necessary for proper formation of the fabric rope into plug form within the chamber or for desired advancement of the plug through the chamber and, in fact, the presence of a continuous inner wall can sometimes pose disadvantages, as already described above. Hence, it is now believed to be desirable only that an inner wall member be provided of sufficient extent at the entrance end of the chamber to properly define and control formation of the fabric rope R into plaited plug form as it initially enters the chamber 26. Specifically, the cross-sectional area defined at the entrance end of the chamber 26 between the side walls 30, the outer wall 32, and the inner wall assembly 44 defines the space within which the entering fabric rope R is constrained to plait into plug form, the spacing between the inner wall assembly 44 and the outer wall 32 defining the front-to-back dimension of the plug, while the spacing between the side walls 30 defines the widthwise dimension of the plug. However, once the fabric is constrained within this entrance end of the chamber 26 to assume a plaited plug form, it has been discovered that the plug form of the fabric will be maintained without inward confinement by an inner wall, with the attendant advantage that any frictional drag imposed on the advancement of the fabric plug by the presence of a continuous inner wall is eliminated.

To assist in the desired formation of the fabric rope R into a plaited plug form upon entering the chamber 26, a deflection plate 42 is disposed within the chamber 26 immediately beneath the exit end of the conduit 34 and is provided with a concave curved surface facing upwardly and outwardly toward the outer wall 32 of the chamber 26. Hence, as the rope R and the entraining liquid L exit the conduit 34, the rope R is directed onto the curved facing surface of the deflection plate 42 which thereby gently directs the cloth rope R outwardly toward the outer wall 32 of the chamber 26, from which the cloth rope then settles gravitationally downwardly into the entrance end of the chamber 26 in the plaited form desired. Advantageously, the deflection plate 42 essentially prevents the cloth rope R from coming into contact with the inner wall assembly 44 until the rope R has initially settled into the desired plug form.

Generally, the adjusted disposition of the inner wall assembly 44 between the various dispositions shown in FIGS. 8 and 9 will be determined as a function of the type of fabric being processed and the total mass of the cloth rope (which in turn determines the total amount of the fabric residing in plug form in the chamber at any given time during on-going processing). Hence, it will generally be recommended to pivot the inner wall assembly 44 into a more closely spaced relation to the outer wall 32 for smaller loads of fabric, i.e., where the fabric mass is lower, and at a more distantly spaced relation from the outer wall 32 for larger loads of fabric having a higher mass. For example, as a general rule, thicker and bulkier fabrics tend to form into plugs of correspondingly larger cross-sectional dimensions, whereby the inner wall assembly 44 would more preferably be spaced farther from the outer wall 32 with increasing fabric bulk and thickness.

Advantageously, the termination of the inner wall assembly 44 substantially in advance of the exit end 26' of the chamber 26 improves the operation of the machine 20 when processing shorter lengths of fabric, i.e., below the maximum capacity of the machine, by enabling the lifter reel to draw fabric from the leading end of the plug without frictional contact or resistance by the inner wall even when the leading end of the plug has not advanced to the exit end of the chamber. The spacing created between the inner wall assembly 44 and the side walls 30 of the chamber 26 by the tapered narrowing of the upper and lower wall members 46,48 provides the additional advantage of preventing the possibility of fabric being damaged by becoming wedged or trapped between the inner wall assembly 44 and the side walls 30. The ease of pivoting adjustability of the inner wall assembly 44 additionally permits greater flexibility in the selective adjustment of one chamber 26 from another chamber 26 within the same vessel 22 as, for example, may be desirable when differing fabric ropes of differing physical characteristics (e.g., differing widths, lengthwise yardage, etc.) are to be subjected to the same wet processing operation, e.g., the dyeing of separate lengths of fabric from which apparel body and trim parts are to be fabricated. The abbreviated inner wall assembly 44 additionally enhances accessibility into the interior of the vessel 11 for servicing.

Figure 10:
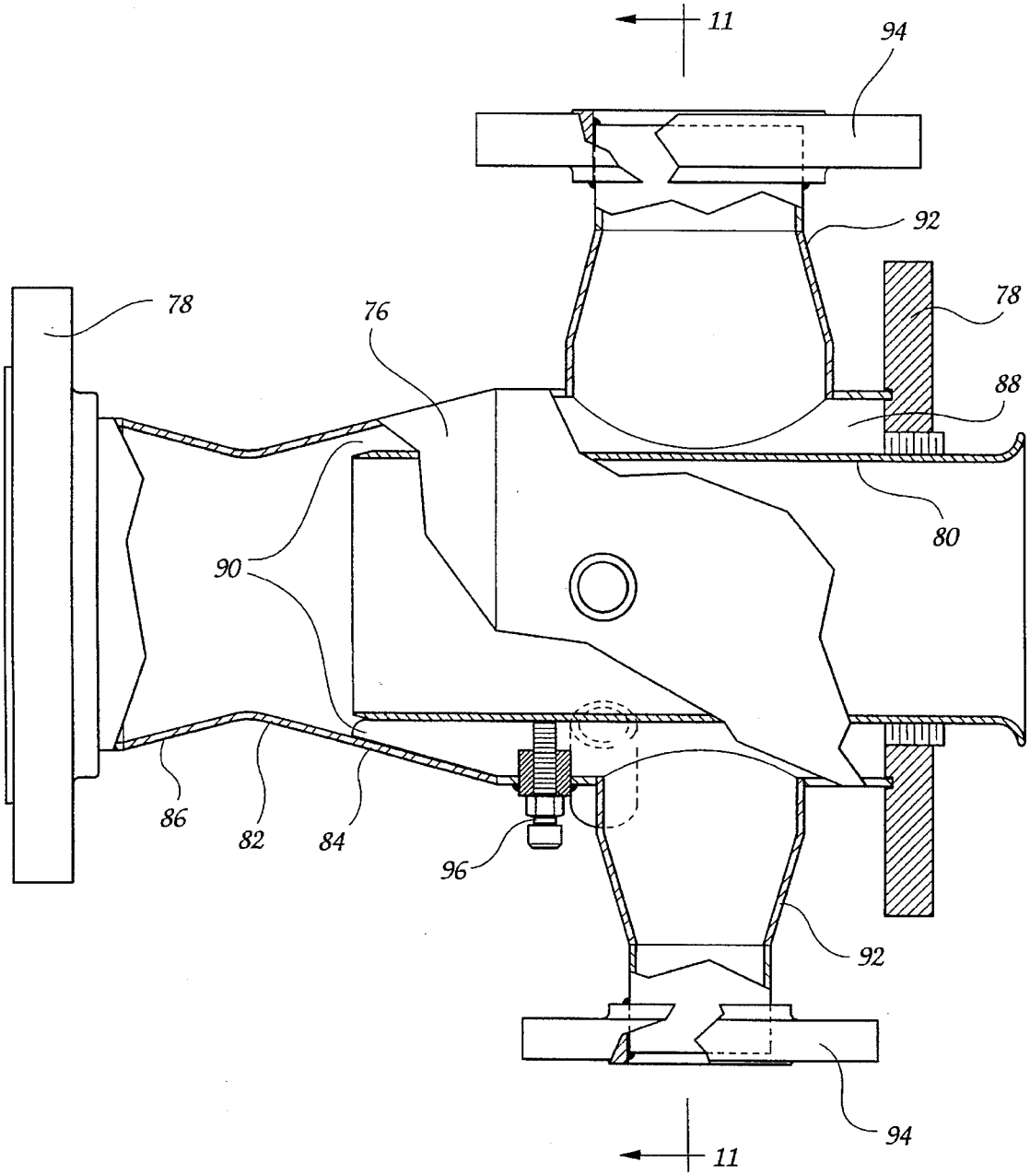
FIG. 10 is a vertical cross-sectional view of the jet structure of the wet processing machine of FIG. 1, taken along line 10—10 thereof.
Figure 11:
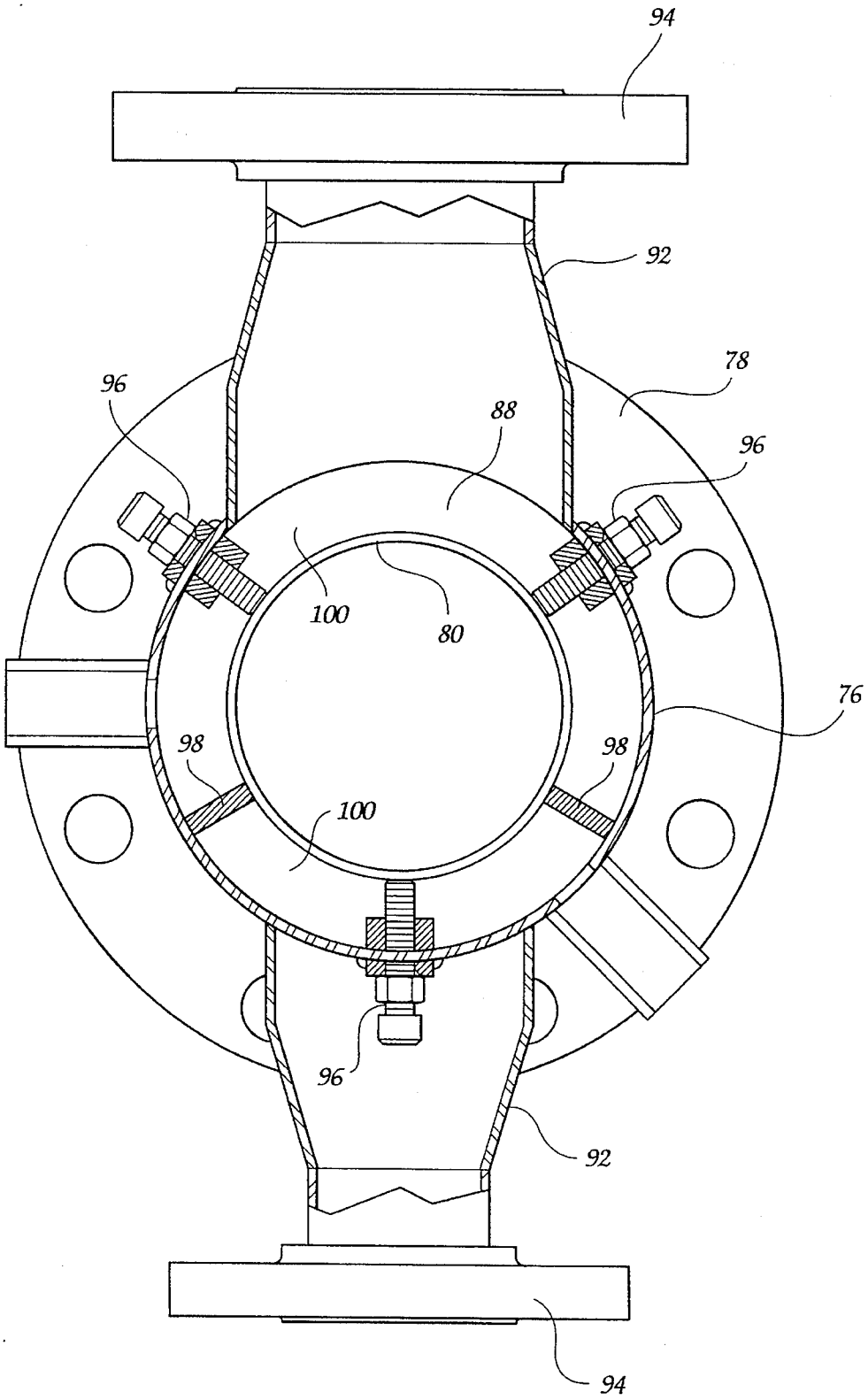
FIG. 11 is a horizontal cross-sectional view of the jet structure of FIG. 10, taken along line 11—11 thereof.

Referring now to FIGS. 10 and 11, the jet nozzle structure 40 is illustrated in accordance with another aspect of the present invention. As is conventional, the jet structure 40 comprises a tubular outer housing 76 from which mounting flanges 78 project outwardly at the opposite ends for bolted securement of the jet structure 40 within the tubular conduit 34 as shown in FIG. 1. A cylindrical fabric transport pipe 80 is supported by the upstream mounting flange 78 (as viewed in relation to the direction of fabric travel through the jet structure 40) to extend coaxially within the interior of the outer housing 76. The downstream end of the outer housing 76 includes a neck portion 82 having a first annular region 84 tapering narrowingly in the downstream direction and then merging with an outwardly tapering annular region 86 terminating at the downstream mounting flange 78.

In this manner, an annular chamber 88 is defined between the outer housing 76 and the interior pipe 80 which is of a generally uniform cross-sectional area at the respective upstream ends of the housing 76 and pipe 80 but progressively decreases in cross-sectional area in the downstream direction to define an annular venturi opening 90 at the point of narrowest cross-sectional area between the terminal end of the interior pipe 80 and the tapered region 84 of the neck portion 82. Three set screws 96 extend radially inwardly through the outer housing 76 at substantially equal circumferential spacings into contact with the outer surface of the interior pipe 80 to support and secure the disposition of the interior pipe 80 within the outer housing 76 and to permit fine adjustment of the relative positioning of the pipe 80 to the housing 76, thereby to ensure that the venturi opening 90 is substantially uniform about its entire annular extent.

Thus, treating liquid L withdrawn from the vessel 22 and pumped under pressure into the chamber 88 (as previously described) is caused to accelerate as it escapes the chamber 88 through the venturi opening 90 and progress therefrom downwardly through the tubular conduit 34 into the entrance end of the chamber 26 within the vessel 22. The cloth rope R, in traveling through the tubular conduit 34, enters the jet nozzle structure 40 through the interior pipe 80 and is continuously impinged by the jetting action of the accelerating annular stream of treating liquid L discharged through the venturi opening 90, thereby imparting a driving force to the cloth rope R to transport it into the chamber 26, as already described above.

As thus far described, the jet nozzle structure 40 is essentially conventional. However, in accordance with the present invention, the jet nozzle structure 40 is provided with two liquid inlet pipes 92 (as opposed to a single inlet pipe as is conventional) affixed to the upstream end of the outer housing 76 at diametrically opposite locations to open into opposite sides of the interior liquid flow chamber 88. The outward end of each liquid inlet pipe 92 is provided with a radial flange 94 for affixation to appropriate piping (shown only representatively by the broken lines indicated in FIG. 1) from the aforementioned liquid circulation pump.

Within the interior chamber 88 of the jet nozzle structure 40, partitioning walls 98 extend axially the full length of the chamber 88 and radially between the outer housing 76 and the interior pipe 80, each partitioning wall 98 being disposed between the two liquid inlet pipes 92 at opposite sides of the chamber 88 thereby to subdivide the chamber 88 into two sub-chambers 100 each communicating with a respective one of the liquid inlet pipes 92. In the preferred embodiment illustrated, the partitioning walls 98 are disposed within the chamber 88 at substantially a 120° circumferential spacing from one another whereby one sub-chamber 100 defines essentially a 120° segment of the overall chamber 88 while the other sub-chamber 100 defines a substantially 240° segment. Of course, however, those persons skilled in the art will readily recognize and understand that the partitioning walls 98 may be disposed at other spacings and, moreover, additional partitioning walls 98 as well as additional liquid inlet pipes 92 could be provided to further subdivide the chamber 88 and segment the incoming liquid flow.

By this unique arrangement, the jet nozzle structure 40 is enabled to operate in a variety of differing modes as may be necessary or desirable to accommodate differing fabrics and differing process considerations and objectives. For example, through appropriate valving in the piping from the liquid recirculation pump P to the two inlet pipes 92 into the jet nozzle structure 40, shown only representatively in FIG. 1 at V, the pressurized treating liquid can be selectively controlled to enter the jet nozzle structure 40 through only one or the other or both of the liquid inlet pipes 92. Hence, without altering the cross-sectional dimension of the venturi opening 90, the jet nozzle structure 40 can be caused to deliver liquid flow at a rate essentially equivalent to that of the same jet nozzle structure 40 with a narrower venturi opening 90 by delivering the entirety of the incoming pressurized liquid exclusively through the larger of the two sub-chambers 100 and, similarly, by delivering the pressurized liquid only into and through the smaller sub-chamber 100, the jet nozzle structure 40 can be caused to operate at a flow rate equivalent to an even more narrowed venturi opening 90.

Apart from the foregoing, whether by delivery of liquid exclusively through one or the other or both sub-chambers 100, and/or by other variation of liquid pressure or flow rate through the two sub-chambers 100, the impingement action by the jetted liquid L on the traveling fabric rope R can be modified from that which would occur with a single inlet directing an essentially uniform liquid flow through the entire annular extent of the venturi opening 90. As will of course be understood, even when pressurized liquid from the circulation pump is delivered into both sub-chambers 100, the differing angular extents of the two sub-chambers cause the impingement action on the fabric rope R to differ at the respective annular extents of the fabric rope R traveling past the correspondingly segmented annular extents of the venturi opening 90.

The aforedescribed unique liquid flow characteristics and the adjustability thereof provided by the segmented configuration of the present jet nozzle structure 40 has unexpectedly been discovered to provide unusually beneficial results in performing wet processing operations with dual lengths of textile fabric. For example, in experiments operating the present wet processing machine 20 to simultaneously circulate and treat two independent and unattached endless fabric ropes R in a single chamber 26 under the circulating influence of a single associated lifter reel 36 and jet nozzle structure 40, it has been found that the two fabric ropes R do not tend to become twisted, looped or otherwise entangled with one another but rather tend to remain separate and detached in essentially side-by-side relation, including forming into essentially separate side-by-side plugs during movement through the chamber 26.

While the particular process or mechanism by which this is accomplished has not been fully determined or understood, it has been observed that the two cloth ropes R tend to deflect from the plate 42 toward opposite lateral sides of the chamber 26. It is theorized that the differing jetting action of the processing liquid L through the respective sub-chambers 100 produces a sufficiently differing impingement effect on annularly opposite sides of the two collective cloth ropes passing through the jet nozzle structure 40 to maintain the ropes separated in side-by-side relation during downstream travel through the remainder of the tubular conduit 34 and, as a result, the fabric ropes R tend to contact the respective sides of the deflection plate 42 and thereby be deflected outwardly to respectively opposite sides of the chamber 26, thus enabling the respective fabric ropes R to settle separately into essentially disentangled side-by-side plugs. As a result, no need is perceived to be required to otherwise maintain the two ropes separated from one another, except that it may be desirable to provide separate poteyes or other suitable guides (not shown) immediately in advance of the lifter reel 36 to maintain the two fabric ropes in separate side-by-side relation as they are presented to the lifter reel.

Another unique process option which this combined action of the jet nozzle structure 40 and deflector plate 42 makes possible is the treating of a single endless rope of fabric in doubled form. Specifically, a single length of fabric would be fed into the machine 20 through the access port 39 and advanced through the chamber 26 until the leading end of the fabric returns to the lifter reel and, then, the leading end of fabric is advanced through the machine a second time until returning again to the lifter reel, at which time the trailing extent of fabric is sewn to the leading end. Hence, the single length of fabric in effect is doubled to form two cloth ropes which cross one another at the connected leading and trailing ends. Processing of such a doubled cloth rope is carried out substantially identically to that of two distinct and disconnected cloth ropes as described above, with the jet nozzle structure 40 and the deflector plate 42 being effective to direct each side-by-side extent of the fabric to opposite sides of the chamber 26 upon entering the vessel 22. In this embodiment, it may also be desirable to provide two separate poteyes for the two extents of fabric immediately in advance of the lifter reel 36, but preliminary experimental operations indicate that it may be desirable to slightly stagger the poteyes relative to one another.

The combined action of the jet nozzle structure 40 and the deflector plate 42 has even been discovered to provide beneficial results when treating a single endless rope of fabric which is not doubled. In such operations, the differential action of the jet nozzle structure 40 tends to cause the single strand of fabric rope to be directed from the tubular conduit 34 into contact with the deflection plate 42 randomly at different locations side-to-side thereacross, thereby causing the fabric rope to be deflected alternately to laterally opposite sides within the chamber 26. As a result, a single strand of fabric rope is caused to automatically settle into the chamber 26 in a plaited configuration without the conventional necessity of providing any mechanical means for doing so, such as the conventional provision of a reciprocably movable cloth tube.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a machine for wet processing of textile fabric in continuous cloth rope form, said machine having a vessel for containing processing liquid and a U-shaped chamber within said vessel for recirculation of the cloth rope therethrough in plug form, said U-shaped chamber having side walls and an outer wall extending from a cloth entrance end of said U-shaped chamber to a cloth exit end of said U-shaped chamber for advance of the cloth plug therealong, the improvement comprising an inner wall movably supported at said cloth entrance end of said U-shaped chamber between said side walls of said U-shaped chamber in spaced relation to said outer wall for selective adjustment of the spacing between said inner wall and said outer wall to control plug formation of the cloth rope, said inner wall having a terminal end disposed between said cloth entrance and exit ends of said U-shaped chamber so that the plug form of the cloth rope is unrestricted inwardly of the U-shaped chamber from said terminal end of said inner wall to said exit end of said U-shaped chamber.

2. The improvement in a textile wet processing machine according to claim 1 and further comprising means for adjustably affixing said inner wall to said side walls of said U-shaped chamber at selective spacings to said outer wall.

3. The improvement in a textile wet processing machine according to claim 1, wherein said inner wall is pivotably mounted between said side walls of said U-shaped chamber for pivotal adjusting movement toward and away from said outer wall.

4. The improvement in a textile wet processing machine according to claim 3, wherein said inner wall is not secured relative to said side walls except at the location of its pivotal support to hang gravitationally therefrom.

5. The improvement in a textile wet processing machine according to claim 1, wherein said side walls extend to an elevation sufficiently above said terminal end of said inner wall for retaining the cloth rope within said U-shaped chamber.

6. The improvement in a textile wet processing machine according to claim 1 and further comprising means disposed within said U-shaped chamber at an elevation above said inner wall for deflecting the cloth rope outwardly toward said outer wall as the cloth rope enters said U-shaped chamber.

7. In a machine for wet processing of textile fabric in continuous cloth rope form, said machine having a vessel for containing processing liquid and means for circulating the cloth rope through said vessel, the improvement wherein said circulating means includes means for creating first and second continuous streams of the processing liquid, each spanning a generally distinct area annularly about the cloth rope, and for impinging the first and second liquid streams onto the cloth rope at respectively different locations annularly thereabout.

8. The improvement in a textile wet processing machine according to claim 7, wherein said liquid impinging means includes housing means defining a central passageway for travel of the cloth rope therethrough, a liquid delivery chamber about the central passageway, a venturi opening from the liquid delivery chamber into the central passageway, and first and second inlets opening into said liquid delivery chamber at annular spacings relative to said central passageway for delivering said first and second streams of processing liquid thereinto.

9. The improvement in a textile wet processing machine according to claim 8, wherein said housing means further includes means dividing said liquid delivery chamber into first and second sub-chambers each communicating with a respective one of said first and second inlets.

10. The improvement in a textile wet processing machine according to claim 9, wherein each of said first and second sub-chambers communicates with said venturi opening through a predetermined annular extent about said central passageway.

11. The improvement in a textile wet processing machine according to claim 10, wherein said predetermined annular extents of said first and second sub-chambers are selected to have respectively differing annular dimensions.

12. The improvement in a textile wet processing machine according to claim 11, wherein one of said sub-chambers has an annular extent of about one hundred twenty degrees (120°) and the other of said sub-chambers has an annular extent of about two hundred forty degrees (240°).

13. The improvement in a textile wet processing machine according to claim 9, wherein said first and second sub-chambers are respectively configured to have differing liquid flow characteristics.

14. The improvement in a textile wet processing machine according to claim 7 and further comprising a lifter roll means for withdrawing the cloth rope from said vessel and delivering the cloth rope to said liquid impinging means, said liquid impinging means being oriented to entrain and redirect the cloth rope into said vessel.

15. The improvement in a textile wet processing machine according to claim 14, wherein the liquid impinging means is oriented to direct said streams of processing liquid generally downwardly toward said vessel.

16. In a method of wet processing of textile fabric in continuous cloth rope form, said method comprising the steps of circulating the cloth rope in plug form through a bath of processing liquid by progressively withdrawing the cloth rope from an exit end of said liquid bath and returning the cloth rope to an entrance end of said liquid bath, the improvement comprising simultaneously circulating two independent and unattached textile fabrics, each in continuous cloth rope form, through said liquid bath in generally side-by-side relation to one another and directing said two cloth ropes of textile fabrics toward laterally opposite sides of said entrance end of said liquid bath when returning said two cloth ropes thereto.

17. The improvement in a textile wet processing method according to claim 16, wherein said step of directing said two cloth ropes toward laterally opposite sides of said liquid bath comprises directing said two cloth ropes collectively through a common means for impinging said collective cloth ropes with first and second continuous streams of said processing liquid at respective locations annularly about said two collective cloth ropes.

18. The improvement in a textile wet processing method according to claim 17, wherein said step of directing said two cloth ropes toward laterally opposite sides of said liquid bath comprises directing said two cloth ropes downstream of said liquid impinging means onto a common deflector plate disposed generally above said entrance end of said liquid bath.

19. In a method of wet processing of textile fabric in continuous cloth rope form, said method comprising the steps of circulating the cloth rope in plug form through a bath of processing liquid by progressively withdrawing the cloth rope from an exit end of said liquid bath and returning the cloth rope to an entrance end of said liquid bath, the improvement comprising the steps of creating first and second continuous streams of the processing liquid, each stream spanning a generally distinct area annularly about the cloth rope, and impinging said cloth rope with first and second continuous streams of said processing liquid at respectively different locations annularly about said cloth rope.

20. The improvement in a textile wet processing method according to claim 19, and further comprising the step of directing said cloth rope downstream of said liquid impinging onto a deflector plate disposed generally above said entrance end of said liquid bath.

21. The improvement in a textile wet processing method according to claim 19, wherein said cloth rope comprises two independent and unattached textile fabrics each in continuous cloth rope form, said circulating step comprising circulating said two cloth ropes through said liquid bath in generally side-by-side relation to one another.

22. The improvement in a textile wet processing method according to claim 19, wherein said cloth rope comprises a continuous length of cloth rope, said circulating step comprising circulating said cloth rope through said liquid bath in a doubled form having two extents in generally side-by-side relation to one another and connected endwise to one another in crossing relation.

23. In a machine for wet processing of textile fabric in continuous cloth rope form, said machine having a vessel for containing processing liquid and means for circulating the cloth rope through said vessel, the improvement wherein said circulating means includes means for impinging first and second continuous streams of the processing liquid onto the cloth rope at respective locations annularly thereabout, said liquid impinging means including housing means defining a central passageway for travel of the cloth rope therethrough, a liquid delivery chamber about the central passageway, a venturi opening from the liquid delivery chamber into the central passageway, first and second inlets opening into said liquid delivery chamber at annular spacings relative to said central passageway for delivering said first and second streams of processing liquid thereinto, and means dividing said liquid delivery chamber into first and second sub-chambers each communicating with a respective one of said first and second inlets.

24. The improvement in a textile wet processing machine according to claim 23, wherein each of said first and second sub-chambers communicates with said venturi opening through a predetermined annular extent about said central passageway.

25. The improvement in a textile wet processing machine according to claim 24, wherein said predetermined annular extents of said first and second sub-chambers are selected to have respectively differing annular dimensions.

26. The improvement in a textile wet processing machine according to claim 25, wherein one of said sub-chambers has an annular extent of about one hundred twenty degrees (120°) and the other of said sub-chambers has an annular extent of about two hundred forty degrees (240°).

27. The improvement in a textile wet processing machine according to claim 23, wherein said first and second sub-chambers are respectively configured to have differing liquid flow characteristics.

28. The improvement in a textile wet processing machine according to claim 23 and further comprising a lifter roll means for withdrawing the cloth rope from said vessel and delivering the cloth rope to said liquid impinging means, said liquid impinging means being oriented to entrain and redirect the cloth rope into said vessel.

29. The improvement in a textile wet processing machine according to claim 28, wherein the liquid impinging means is oriented to direct said streams of processing liquid generally downwardly toward said vessel.

30. In a method of wet processing of textile fabric in continuous cloth rope form, said method comprising the steps of circulating the cloth rope in plug form through a bath of processing liquid by progressively withdrawing the cloth rope from an exit end of said liquid bath and returning the cloth rope to an entrance end of said liquid bath, the improvement comprising circulating two independent and unattached textile fabrics, each in continuous cloth rope form, through said liquid bath in generally side-by-side relation to one another, including directing said two cloth ropes through a means for impinging said cloth rope with first and second continuous streams of said processing liquid at respective locations annularly about said cloth ropes.

31. The improvement in a textile wet processing method according to claim 30, and further comprising the step of directing said two cloth ropes toward laterally opposite sides of said liquid bath by directing said cloth rope downstream of said liquid impinging means onto a deflector plate disposed generally above said entrance end of said liquid bath.

32. In a method of wet processing of textile fabric in continuous cloth rope form, said method comprising the steps of circulating the cloth rope in plug form through a bath of processing liquid by progressively withdrawing the cloth rope from an exit end of said liquid bath and returning the cloth rope to an entrance end of said liquid bath, the improvement comprising circulating said cloth rope through said liquid bath as a continuous length of cloth rope in a doubled form having two extents in generally side-by-side relation to one another and connected endwise to one another in crossing relation, including directing said cloth rope through a means for impinging said cloth rope with first and second continuous streams of said processing liquid at respective locations annularly about said cloth rope.

* * * * *